US006966204B2

(12) United States Patent
Bollmann

(10) Patent No.: US 6,966,204 B2
(45) Date of Patent: Nov. 22, 2005

(54) WASHING MACHINE DOOR FOR A FRONT-LOAD WASHING MACHINE

(75) Inventor: Andreas Bollmann, Adelberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 513 days.

(21) Appl. No.: 10/238,310

(22) Filed: Sep. 10, 2002

(65) Prior Publication Data

US 2003/0046964 A1 Mar. 13, 2003

(30) Foreign Application Priority Data

Sep. 11, 2001 (DE) ..... 101 44 767

(51) Int. Cl.[7] ..... D06F 37/10
(52) U.S. Cl. ..... 68/196; 68/139
(58) Field of Search ..... 68/139, 24, 58, 68/196; 34/601, 603

(56) References Cited

U.S. PATENT DOCUMENTS 6,256,823 B1 * 7/2001 Kronbetter et al. ..... 8/158
6,269,667 B1 * 8/2001 Back et al. ..... 68/17 R
2004/0020246 A1 * 2/2004 Yun et al. ..... 68/24
2004/0244435 A1 * 12/2004 Kim ..... 68/12.26

FOREIGN PATENT DOCUMENTS

| | | | | |
|---|---|---|---|---|
| DE | 8304273 | | 6/1983 | ..... D06F 39/00 |
| DE | 3603211 | | 8/1987 | |
| DE | 3603211 A | * | 8/1987 | ..... D06F 37/28 |
| DE | 19515040 | | 10/1996 | |
| DE | 19515040 A1 | * | 10/1996 | ..... D06F 37/10 |
| EP | 0293984 | | 12/1988 | ..... D06F 39/14 |

* cited by examiner

*Primary Examiner*—Joseph L. Perrin
(74) *Attorney, Agent, or Firm*—John F. Colligan; Robert O. Rice; Stephen Krefman

(57) ABSTRACT

The invention concerns a washing machine door for a front-load washing machine that has a frontal frame hinged to the housing of the machine and that surrounds a loading opening, into which a transparent frontal door cover is inserted from the drum side and is held in by a mounted gallows frame. If according to the invention the provision is made that the frontal frame has bayonet hooks on the backside facing the frontal door cover that are inserted into receiving slots of the frontal door cover and held therein when the frontal door cover is rotated; that at least part of the bayonet hooks provide fashioned screw domes onto which receptacle domes of the gallows frame can be form locked; and that the gallows frame with bent rest tabs can be snapped into the rest slots of the frontal door covering.

9 Claims, 2 Drawing Sheets

WASHING MACHINE DOOR FOR A FRONT-LOAD WASHING MACHINE

BACKGROUND OF THE INVENTION

1. Field of the Invention

The invention concerns a washing machine door for a front-load washing machine that has a frontal frame hinged to the housing of the machine and that surrounds a loading opening, into which a transparent frontal door cover is inserted from the drum side and which is held in by means of a mounted gallows frame.

2. Description of the Related Art

Such a washing machine door is known from DE 195 15 040 C2 and is round in shape. With this known washing machine door, connecting the three essential components—frontal frame, frontal door cover and gallows frame, is associated with substantial assembly effort.

A door for a drum washing machine is known from DE 36 03 211 A1 that comprises a transparent pan-like glass, the surrounding edge of which is attached in a frame. The frame in turn comprises an outer opening ring and an inner fitting part. The fitting part is snapped into the opening ring and the fitting part is welded by means of a coin die such that the edge of the face wheel is localized. This adds to the expense of assembling the door considerably, however.

It also is known in the art to have a door for a drum washing machine that provides a transparent face wheel with a surrounding edge. The edge is held in two complementary rings as a frame that can be assembled. The rings are snapped together and hold the edge of the face wheel in place with flanges that protrude inwards. Consequently, a defined angle between the frame and the face wheel is not ensured and the grip of the edge of the face wheel between both flanges is not always sufficient.

SUMMARY OF THE INVENTION

It is the task of the invention to provide a washing machine door of the type mentioned at the outset in which the three basic components—frontal frame, frontal door cover and gallows frame, can be assembled with a simple design quickly and securely into a stable module.

This task is solved according to the invention in that the frontal frame has bayonet hooks on the backside facing the frontal door cover that are inserted into receiving slots of the frontal door cover and held therein when the frontal door cover is rotated; in that at least part of the bayonet hooks provide fashioned screw domes onto which receptacle domes of the gallows frame can be form locked; and in that the gallows frame can be engaged in rest slots of the frontal door cover with bent caps.

With the bayonet connections between the frontal frame and the frontal door cover, both components are connected by a simple insertion action with a small turn into an assembly position, in which the gallows frame is merely inserted and snapped to the frontal door cover. Separate connector elements are not required since these are all arranged on the three components, preferably as one piece or molded. The connections can be implemented to provide zero-backlash so that when operational the assembled washing machine door does not make any noise. All the connection points between the three components are covered and enable a design freedom, which lend the washing machine a high appliance quality.

A module created accordingly can be used for different washing machine doors, wherein hinge parts, handles, etc. to be added on influence the aesthetic image as a whole.

One arrangement of the bayonet connectors provides that the free end pieces of the bayonet hooks are in the same rotational sense in circumferential direction of the frontal frame, and that the widths of the receiving slots are aligned to the widths of the bayonet hooks, in particular their free end pieces, and are larger in their circumferential dimension by one locking path than the length of the free end pieces. According to the turn, the frontal frame and the frontal door cover, which is transparent, take a defined assembled position for attaching the gallows frame, if the additional provision is given that the rotational twist of the frontal door cover attached to the bayonet hooks is limited by at least one stop on the backside of the frontal frame that is guided in a receptacle of the frontal door cover and catches.

Attaching the gallows frame is made easier in that the screw domes of the bayonet hooks of the frontal frame provide a truncated cone-shaped outer contour and the receptacle domes of the gallows frame provide a truncated cone-shaped inner receptacle, the diameters and the tapers of which are calibrated to each other, wherein the gallows frame is aligned at the same time to the pre-assembled module of frontal frame and frontal door cover.

A pre-configured and often adequate localization of the gallows frame is achieved according to one design in that the rest tabs of the gallows frame are die-cut in an L-shape and bent, and that rest links or rest edges on the end of the rest tabs reach behind the catch slot of the frontal door cover. Connection and stability can be substantially improved however, in that the screw domes of the frontal frame are also screwed with the receptacle domes of the gallows frame, without incurring cumbersome, additional part and assembly expenses.

The coverage of all fastening locations and a pleasing, shapely appearance of the washing machine door module are provided in that the frontal frame is closed on the front side and it covers the gallows frame with the snap connections to the frontal door cover and with the bayonet connections between the frontal frame and the frontal door cover as well as the snap-in connection between the receiving domes of the gallows frame and the screw domes of the frontal frame.

In order for the frontal door cover to be able to extend out widely into the area between the frontal frame and the gallows frame, one design provides that the screw domes of the frontal frame are lead through breakthroughs in the frontal door cover into the receiving domes of the gallows frame.

If a subsequent design stipulates that the frontal door cover props over rounded support surfaces of the interior side of the frontal frame, then a gap between the frontal frame and the frontal door cover is avoided.

BRIEF DESCRIPTION OF THE DRAWINGS

The invention is described in more detail by means of example embodiments shown in the drawings.

DESCRIPTION OF THE PREFERRED EMBODIMENT

Figure 1:
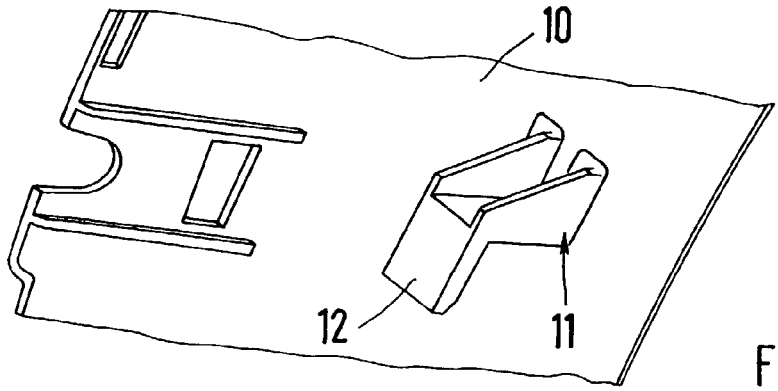
FIG. 1 shows a partial view of the backside of the frontal frame with bayonet hooks arranged.
Figure 2:
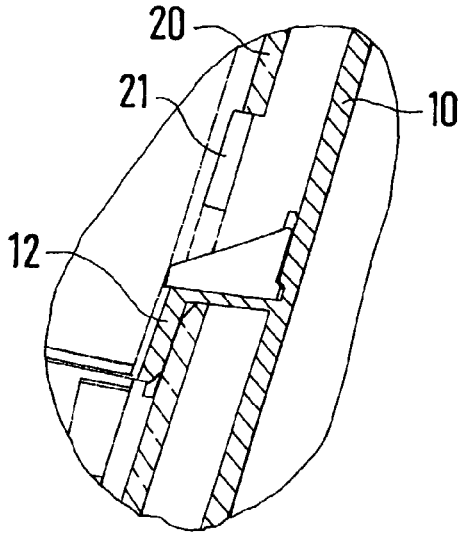
FIG. 2 shows in the local section a snap connection with a bayonet hook of the frontal frame and a receiving slot in the frontal cover.
Figure 3:
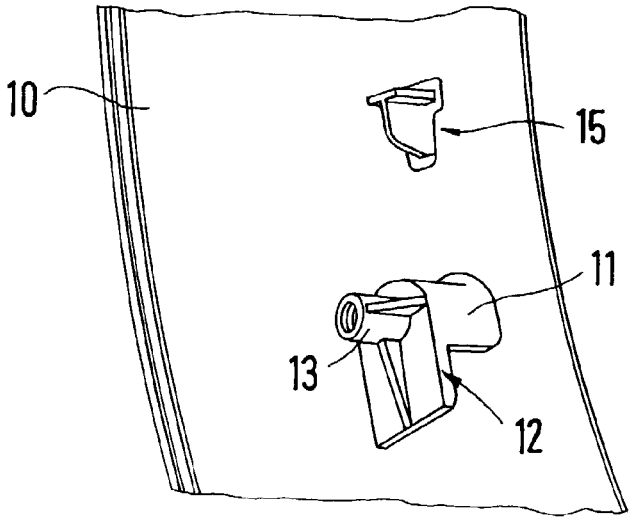
FIG. 3 shows a partial view of the backside of the frontal frame with a bayonet hook provided with screw domes and an additional stop.

FIG. 1 only shows only one section of the circular frontal frame 10, which can also be cropped by a straight line in the upper section. Four bayonet hooks are distributed over the contour, for example at a 90° pitch, that have an L-shape design and that stand with their free end pieces 12 at a pre-determined distance at the backside of the frontal frame 10. The forms of the frontal frame 10 and the frontal door cover 20 determine this distance. The free end pieces 12 of the bayonet hooks 11 are aligned in the same rotational sense in circumferential direction of the frontal frame 10 and are inserted into receiving slots 21 of the frontal door cover 20, as is shown in FIG. 2. The widths of the receiving slots 21, which point in the circumferential direction, are adjusted to the widths of the bayonet hooks 11, in particular the free end pieces 12.

The dimension of the receiving slots 21 in circumferential direction of the frontal door cover 20 is larger than the length of the free end pieces 12, such that by accordingly surrounding the frontal door cover 20 against the frontal frame 10, preliminary localization of both elements is achieved as seen in FIG. 2. In so doing the frontal door cover 10 props up over rounded contact surfaces on the inside of the frontal frame 10 to prevent the formation of a gap. Rotation is thereby limited by means of a stop 15 on the backside of the front fame 10 that is inserted into a receptacle of the frontal door cover 20 and that catches in this and therefore determines the installation lay-out between the frontal frame 10 and the frontal door cover 20.

Figure 4:
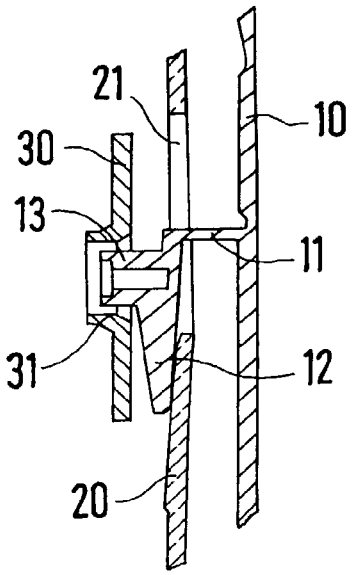
FIG. 4 shows a partial section of a rest connection between frontal frame and frontal door cover, wherein the screw dome of the bayonet hook is inserted into a receiving dome of the gallows frame.
Figure 5:
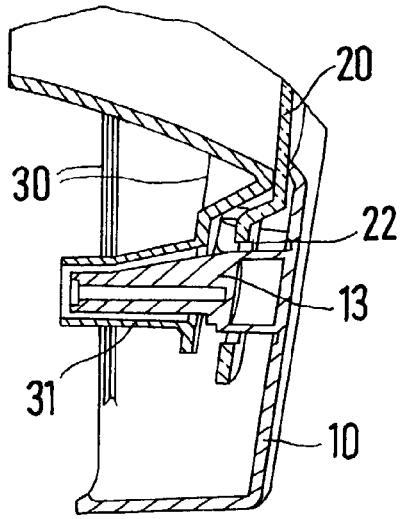
FIG. 5 shows a local section corresponding to FIG. 4, wherein screw dome and receiving dome are set up for an additional connection, however.
Figure 6:
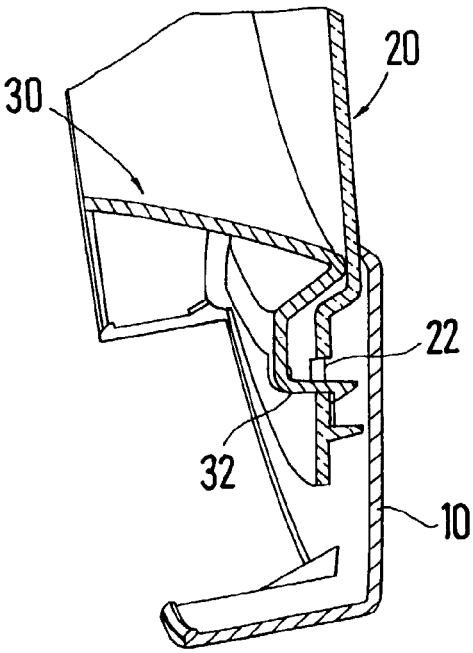
FIG. 6 shows in the local section a catch between the gallows frame and the frontal door cover.

As shown in FIGS. 4 and 5, the gallows frame 30 can be inserted onto the pre-assembled module of frontal frame 10 and frontal door cover 20. The gallows frame 30 has molded receiving domes 31 molded onto the bayonet hooks 11 in the distribution of screw domes 13 that are calibrated to each other in terms of cross-section and shape such that the gallows frame 30 can be arranged into correct assembly position. In addition, die-cut and bent rest tabs 32 on gallows frame 30 can snap into snap slots 22 of the frontal door cover 20, as is shown in FIG. 6. These snap connections can be supported further by screwing one part of the screw dome 13 of the frontal frame 10 to receiving dome 31 of the gallows frame 30, particularly if these are designed appropriately, as shown in the cross-section of FIG. 5.

The washing machine door module, made in this way with simple components, can be provided by known methods with hinges, handles, etc and used for the installation of different washing machine doors. A sight glass that protrudes into the inside of the drum can be additionally added to the washing machine-module consisting of frontal frame 10, frontal door cover 20 and gallows frame 30.

What is claimed is:

1. A washing machine door for a front-load washing machine that includes a frontal frame hinged to the housing of the machine and that surrounds a loading opening, into which a transparent frontal door cover is inserted from the drum side and is held in by a mounted gallows frame, wherein the frontal frame has bayonet hooks on the backside facing the frontal door cover that are inserted into receiving slots of the frontal door cover and held therein when the frontal door cover is rotated, at least part of the bayonet hooks provide fashioned screw domes onto which receptacle domes of the gallows frame is form locked and the gallows frame is engaged in rest slots of the frontal door cover with bent caps.

2. A washing machine door according to claim 1, wherein the free end pieces of the bayonet hooks are aligned in the same rotational sense in circumferential direction of the frontal frame and that the widths of the receiving slots are aligned to the widths of the bayonet hooks, in particular their free end pieces, and are larger in their circumferential dimension by one locking path than the length of the free end pieces.

3. A washing machine door according to claim 2, wherein the rotational twist of the frontal door cover attached to the bayonet hooks is limited by at least one stop on the backside of the frontal frame that is guided in a receptacle of the frontal door cover and catches.

4. A washing machine door according to claim 3, wherein the screw domes of the bayonet hooks of the frontal frame provide a truncated cone-shaped outer contour and the receptacle domes of the gallows frame provide a truncated cone-shaped inner receptacle, the cross-sections and the tapers of which at calibrated to each other.

5. A washing machine door according to claim 4, wherein the rest tabs of the gallows frame are die-cut in an L-shape and bent, and that rest links or rest edges on the end of the rest tabs reach behind the catch slots of the frontal door cover.

6. A washing machine door according to one of claim 5, wherein the frontal frame is closed on the front side and coven the gallows frame with the snap connections to the frontal door cover and with the bayonet connections between the frontal frame and the frontal door cover as well as the snap-in connection between the receiving domes of the gallows frame and the screw domes of the frontal frame.

7. A washing machine door according to one of claim 6, wherein the screw domes of the frontal frame are lead through breakthroughs in the frontal door cover into the receiving domes of the gallows frame.

8. A washing machine door according to one of claim 7, wherein the screw domes of the frontal frame are also screwed with the receiving domes of the gallows frame.

9. A washing machine door according to one of claim 8, wherein the frontal door cover props over rounded support surfaces of the interior side of the frontal frame.

* * * * *